United States Patent [19]

Near

[11] Patent Number: 4,893,727

[45] Date of Patent: Jan. 16, 1990

[54] AUTOMATED RETAIL SERVICE DELIVERY SYSTEM

[76] Inventor: Michael A. Near, 10101 Tuxford Rd., Richmond, Va. 23236

[21] Appl. No.: 229,465

[22] Filed: Aug. 8, 1988

[51] Int. Cl.[4] ..... G07F 11/00

[52] U.S. Cl. ..... 221/81; 221/82; 221/83; 221/86; 221/90; 221/120; 221/121; 221/194; 194/205

[58] Field of Search ..... 221/83, 82, 12, 9, 79, 221/81, 86, 89, 90, 119, 120, 121, 122, 133, 123, 191, 194, 289; 194/205

[56] References Cited

U.S. PATENT DOCUMENTS

| | | | |
|---|---|---|---|
| 816,975 | 4/1906 | Gilbert | 221/113 |
| 1,987,914 | 1/1935 | Smith | 221/113 |
| 3,104,028 | 9/1963 | Brown | 221/86 |
| 3,243,034 | 3/1966 | Mueller et al. | 221/113 X |
| 4,668,150 | 5/1987 | Blumberg | 221/195 X |

FOREIGN PATENT DOCUMENTS

| | | | |
|---|---|---|---|
| 3533734 | 3/1987 | Fed. Rep. of Germany | 221/90 |
| 3741053 | 6/1988 | Fed. Rep. of Germany | 221/12 |
| 2549624 | 1/1985 | France | 194/205 |

*Primary Examiner*—Joseph J. Rolla
*Assistant Examiner*—David H. Bollinger
*Attorney, Agent, or Firm*—Richard C. Litman

[57] ABSTRACT

An automated delivery system includes a unitary wheel assembly having a plurality of horizontally disposed tiers each supporting a plurality of radially extending product bins. Electronic control components including customer interfacing devices, regulate the operation of a motor to rotate the wheel assembly to position a specific bin juxtaposed a single, fixed delivery chute, at which point one stationary discharge assistant as provided for each tier is actuated to manipulate a gate assembly associated with each bin to cause the discharge of its product, by gravity, into the chute. Input keyboard, monitor, credit card and currency processing devices connected to the control components permit varied types of transactions by customers of the system.

10 Claims, 3 Drawing Sheets

AUTOMATED RETAIL SERVICE DELIVERY SYSTEM

FIELD OF THE INVENTION

This invention relates generally, to product delivery mechanisms and more particularly, to an improved system allowing for the self-service delivery of one or more types of products from a single mechanism.

BACKGROUND OF THE INVENTION

Vending apparatus for dispensing consumer items of varying types are well recognized and employ numerous configurations, usually dictated by the nature of the product. Self-service delivery devices for candy and tobacco items usually utilize a plurality of adjacent, stacked arrays, each with a bottom discharge assistant, in view of the common configuration of the product involved. Alternatively, the stacked arrays may be disposed in cylindrical arrangement, again relying upon gravity to advance the stacked products to a bottom discharge assistant. In this latter instance, the individual vertical arrays may be angularly indexed to a single, common discharge mechanism.

Examples of the above described systems will be found in U.S. Pat. Nos. 816,975 issued to Gilbert on Apr. 3, 1906; 1,987,914 issued to Smith on Jan. 15, 1935; and 3,243,034 issued on Mar. 29, 1966 to Mueller et al. Further development in the automated delivery field will be evidenced by the apparatus presented in U.S. Pat. No. 4,668,150 issued May 26, 1987 to Blumberg and which illustrates a plurality of vertically spaced apart product bins with a single product discharge mechanism mounted for both vertical and horizontal shifting to access any one bin.

None of the above referenced devices suggest the novel construction advanced by the present invention and which offers improved speed, efficiency and flexibility on the part of both the vendor and customer.

SUMMARY OF THE INVENTION

By the present invention, an improved automated retail service delivery system is presented and which permits the offering, in a single apparatus, of products of varying configurations, as contained in a plurality of bins adjacently disposed in a circular wheel fashion. A plurality of such wheels are mounted in a vertically stacked manner to provide several tiers, contributing to a unitary wheel assembly. Each tier is provided with a stationary discharge assistant, in the form of a solenoid actuated, pivotal discharge arm, radially aligned with respect to a common discharge chute serving all of the tiers.

When a customer has been properly identified and/or appropriately paid for their desired goods, by means of electronic devices included with the apparatus, the wheel assembly is arcuately indexed or displaced to position the proper bin between the discharge device for that particular tier and the delivery chute. The discharge arm for that tier is activated to open the specified bin and allow the goods to migrate by gravity through the chute to a customer delivery door.

Included in the system are suitable electronic devices to permit identification of the customer, when necessary, and to accept and verify payment, either by cash or credit card. Customer identification will be necessary whenever the goods comprise restricted delivery items such as, completed photographic services or video tapes available only to current members of vendor rental plans, etc.

An inventory of available products is readily presented by means of CRT or monitor and included computer hardware and software regulates the entire operation of the system. In this manner, a plurality of the delivery units or kiosks, each with its own electronic components, communicate with a remote computer system maintaining the necessary data base overseeing the control of all of the individual units. Thus management will at all times have hands-on control over the plurality of units including, inventory status, financial balances and even who is using any one of the units, in the case of customer identifiable usage.

Accordingly, one of the objects of the present invention is to provide an improved automated retail service delivery system including a wheel assembly having a plurality of vertically spaced tiers each provided with a plurality of product bins and with a discharge mechanism for each tier operable to open a designated bin as the wheel is rotated, following customer selection.

A further object of the present invention is to provide an improved automated delivery system including multiple tiers each having a plurality of circularly arranged inclined bins, with all tiers and bins rotatable as a unitary assembly to position a selected bin intermediate a separate discharge assistant for each tier and a common chute.

Another object of the present invention is to provide an improved automated delivery system including a plurality of rotatable multi-bin tiers each cooperating with a stationary discharge assistant, with the tier rotation and subsequent discharge actuation being automatically initiated by a customer, through electronic devices providing customer identification, check-control operation and currency acceptance and change return.

Still another object of the present invention is to provide an improved automated delivery system including a plurality of vertically stacked tiers each having a plurality of circularly disposed inclined bins in turn having a closed inner wall and an open outer end and wherein spring means normally retains a bin product gate in a closed position until a discharge assistant is activated to open the bin gate to allow gravity to discharge the contents into a single common chute.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
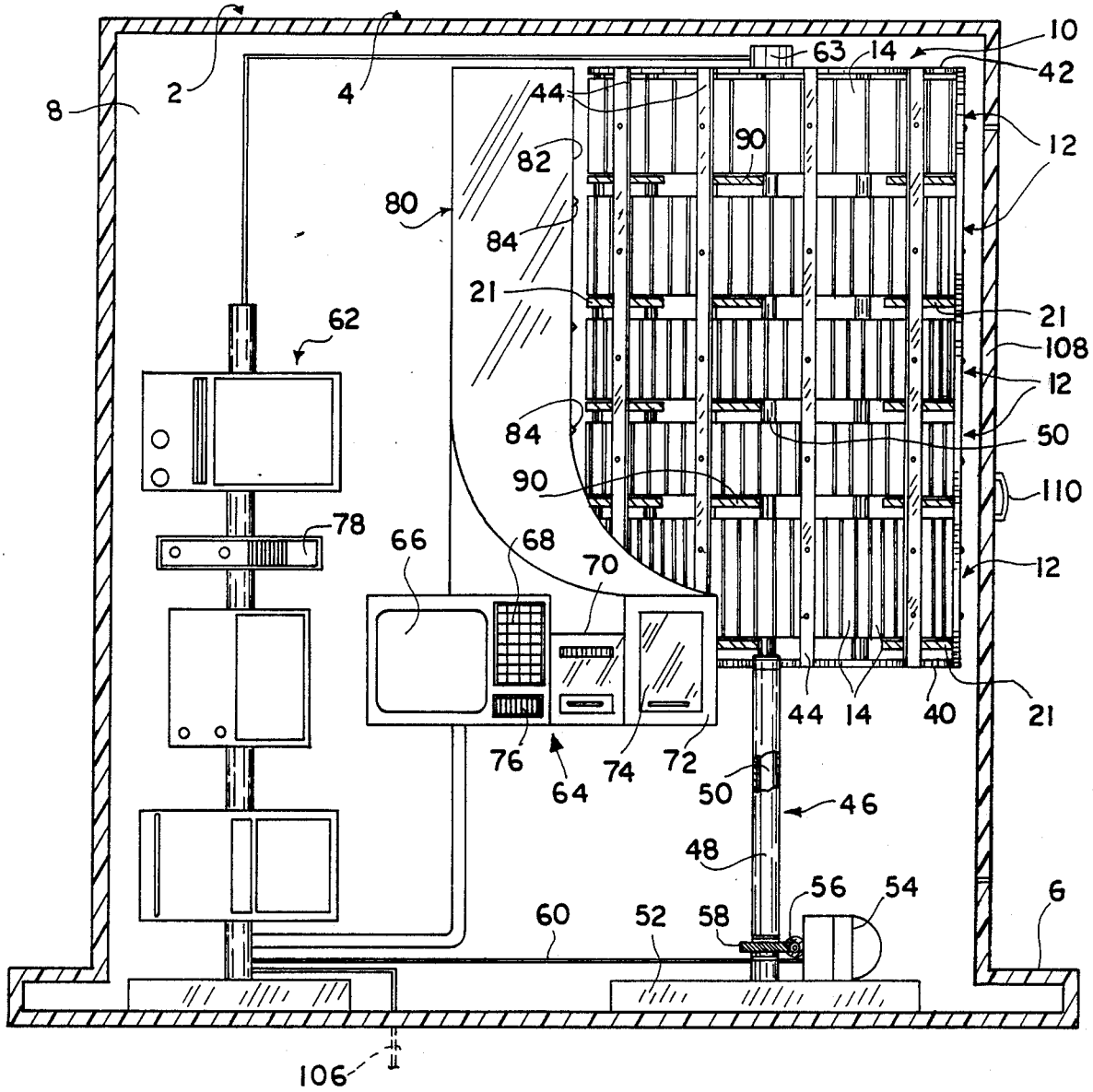
FIG. 1 is a front elevation, partly in section, of an assembly according to the present invention.

Referring now to the drawings, particularly FIG. 1, the present invention will be seen to comprise a delivery system, generally designated 2, and which includes an outermost housing or cabinet 4, adapted to be supported upon a stable platform such as a floor or paved lot, as in shopping center. In this respect, an outcrop or curb 6, may be provided adjacent the base of the cabinet 4 to prevent customers arriving in their vehicles, from striking the cabinet.

Figure 5:
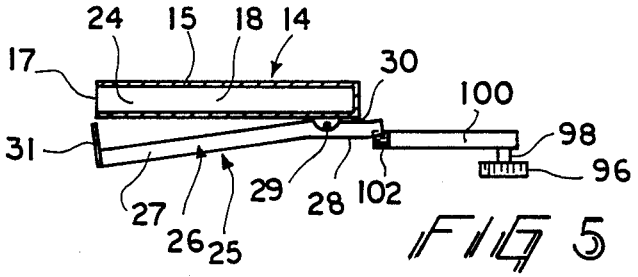
Figure 6:
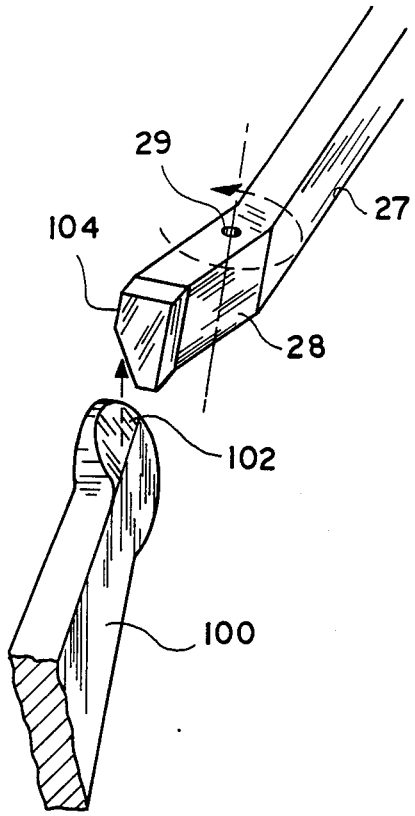

The primary merchandise component within the confines of the cabinet interior 8 will be seen to comprise a wheel assembly 10 and which includes a plurality of wheels or tiers 12, vertically stacked in a spaced apart manner. Each of these tiers includes a plurality of product bins 14 arranged in a circular ring-like manner with the diameter of all of the tiers preferably being identical. As shown most clearly in FIGS. 3 and 5 of the drawings, each inclined bin 14 comprises a pair of laterally spaced apart, vertical side walls 15—15 joined by a straight bottom wall 16. The outer portion of each bin defines an open, outer end 17 while the rear includes a closed, rear wall 18. Preferably, the top 19 is open so as to minimize interference during discharge of the product 20 therein as will be described hereinafter.

Figure 4:
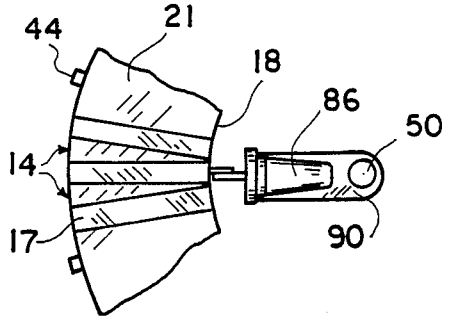
FIG. 4 is a fragmentary top plan of the structure of FIG. 3.
Figure 3:
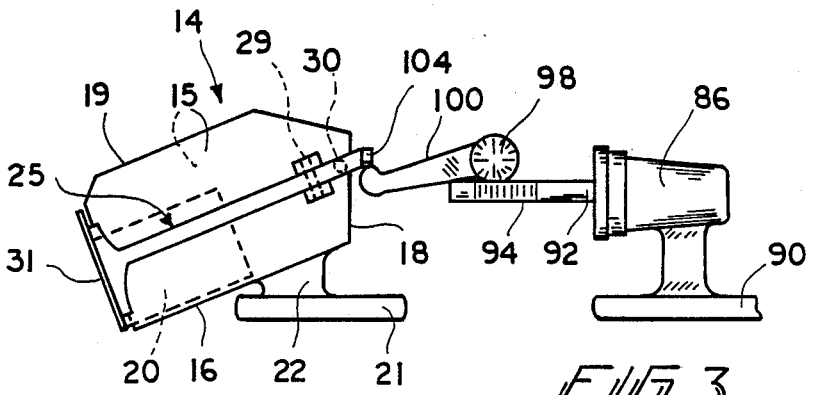
FIG. 3 is a side elevation illustrating the manner of operation of the mechanism of FIG. 2, with one of the product bins.

The plurality of bins 14 of each tier 12 will be understood to be radially aligned as shown in FIGS. 3 and 4 and are supported upon a common circular, horizontally disposed bin support 21. The attachment therebetween is provided by a bin mount 22 depending from the bottom of each bin and will be seen to be fixedly attached to the upper surface 23 of the support 21. This attachment is such that the bottom 16 of each bin is maintained in an inclined position relative the support upper surface 23 with the outer, open end 17 being downwardly directed to normally urge any consumer item 20 within the bin interior cavity 24 toward the bin open end 17.

Each bin is equipped with a gate assembly, generally designated 25, and which comprises a lever 26 including a longer outer section 27 angularly disposed relative a shorter inner section 28. This lever 26 will be seen to be hingedly attached to one side wall 15 by means of a pivot pin 29 engaging the lever intermediate the two angular sections 27,28. Biasing means, such as a compression spring 30, engages the short, inner lever section 28 to urge the gate assembly into its normal, closed or at rest position as shown in FIG. 3 wherein, a transverse product gate 31 carried by the distal portion of the lever outer section 27 will overlie or enclose the open end 17 of the bin 14. In this position it will follow that product 20 within any bin will be retained until such time as the gate assembly 25 is actuated to an open position, as reflected in FIG. 5. The manner of this actuation will be described hereinafter.

It will be appreciated that the width of the various bins 14, either within any one tier 12 or between the various tiers, may vary so as to permit the accommodation of products 20 of varying dimensions. Thus, processed film, new film, batteries, etc. may be handled by any one system 2 without altering the construction of the apparatus other than the width of selected bins 14.

The plurality of tiers 12 are all part of a unitary wheel assembly 10. This is accomplished by interlocking the tiers by any suitable arrangement insuring concurrent arcuate or angular displacement of the various tiers and their bins. As shown in FIG. 1 of the drawings, the wheel assembly 10 includes a bottom wall 40 beneath the lowermost tier and a top wall 42 atop the uppermost tier. A plurality of vertical supports 44 interconnect the two walls 40,42 and in turn, are attached to each tier, such as at the horizontal bin support 21. The entire wheel assembly 10 is mounted about a central support assembly 46 including an outer wheel support member or tube 48 suitably affixed to the wheel assembly bottom wall 40. Included within the tube 48 is a fixed central shaft 50, extending from the base 52 to the full height of the wheel assembly. Suitable well known bushing or bearing means (not shown) is provided at the upper end of the shaft 50 to stabilize the assembly.

With the above construction in mind, it will be appreciated that upon rotation of the support member 48, the wheel assembly 10 will be arcuately displaced about the fixed shaft 50, in view of the rigid attachment of the support member 48 to the wheel assembly bottom wall 40. To initiate this indexing or rotation of the wheel assembly, a stepping motor 54 is provided and includes a drive gear 56 engageable with a driven, wheel gear 58 fixed to the support tube 48. The regulation of this motor 54 will be understood to be accomplished through a circuit 60 communicating with electronic control components 62 within the cabinet 4 and in concert with an encoder 63 atop the wheel assembly. Exposed through the unit cabinet 4 is a customer console 64 having a CRT or video monitor 66, input keyboard 68, credit card and currency station 70 and a delivery port 72 having a customer door 74. A speaker/microphone 76 may also be provided to offer either two-way vocal communication with a central master location or permit the recording of customer instructions and playback of recorded messages applicable to the instruction as input by the customer through the keyboard 68. The electronic components 62 may include an alarm 78, operable both locally as well as at any remote location, to signal tampering or other unauthorized activity.

According to the instructions input by the customer, the wheel assembly 10 will be rotated by means of the motor 54, to position the applicable bin 14 juxtaposed a fixed delivery chute 80. This chute comprises a substantially vertical enclosure having an open delivery face 82 closely spaced from the periphery of the wheel assembly. Serving as guide means are a plurality of discharge ramps 84 leading downwardly from a point just below the plane of each tier support 28. In this manner it will be seen that upon the opening of any bin gate assembly 28 that is juxtaposed one of the chute ramps 84, the contained product 20 will be urged by gravity into the chute 80 and thence to the customer delivery door 74 for retrieval.

Figure 2:
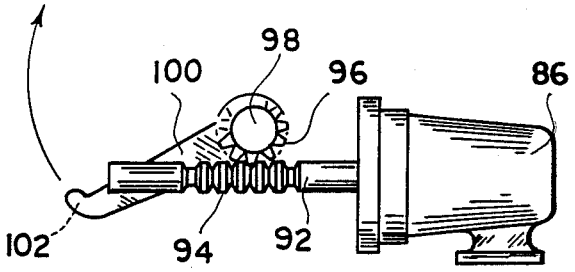
FIG. 2 is an enlarged side elevation of the discharge mechanism as provided for each tier shown in FIG. 1.

The above referenced discharge action is accomplished by means of discharge motor means such as the solenoid motor 86 shown in FIGS. 2-4. One such discharge assistant 86 is provided for each tier 12 and includes a mounting base 88 fixedly attached to a stationary discharge mechanism support 90 secured relative the fixed central shaft 50. Each motor 86 includes a reciprocating shaft 92 provided with suitable gearing 94 engaging a mating gear 96 on a pivot shaft 98. Integral with the gear 96 and its shaft 98 is an activator arm or lever 100 provided with a free end having an actuating end defining an outwardly inclined cam face 102. The activator arm 100 and motor shaft 92 are substantially radially aligned, similar to the plurality of bins 14, such that when a specified bin is rotated into position intermediate the activator lever 100 and associated chute ramp 84, actuation of the related motor 86 causes the cam face 102 to be elevated. This movement produces an engagement between the cam face 102 and an upwardly inclined cam surface 104 formed adjacent the distal portion of the inner lever section 28 with the result that the entire gate assembly 25 is pivoted about the pin 29 and the product gate 31 is laterally shifted away from its normal, blocking position at the open end of the bin. With the gate thusly displaced, the bin contents 20 are free to slide by gravity down the adjacent ramp 84 and then to the customer retrieval door 74. From the foregoing it will be seen that means are provided to allow customers to select either one of many different products being offered for general sale or, to retrieve a specifically ordered item intended only for that customer. The vendor will be able to load particular bins 14 with specific product items 20 and then, through the electronic components 62, program the system to recognize authorized commands as entered by customers through the input keyboard 68. Such programming may be accomplished at the specific unit 2 and/or from a remote master location, communicating with the unit 2 by the circuit 106. One or more doors 108 with suitably controlled access means 110 allow authorized personnel to service the contents of the unit. Quite obviously, each bin 14 will contain appropriate indicia (not shown) to permit servicing personnel to identify which bin is to be loaded with what product.

It is to be understood that the present invention is not limited to the sole embodiment described above, but encompasses any and all embodiments within the scope of the following claims.

I claim:

1. An automated delivery system comprising:

a wheel assembly including a plurality of circular tiers, each said tier provided with a plurality of storage bins adapted to contain a product to be dispensed, each said bin having a gate assembly displaceable between an open and a closed position, horizontal bin support means beneath said bins of each said tier, means interlocking said tiers into a unitary assembly, wheel assembly support means engageable with and maintaining said wheel assembly at a fixed elevation, a delivery chute adjacent the outer periphery of said wheel assembly, indexing motor means operable to rotate said wheel assembly to position a selected one of said bins on any said tier juxtaposed said delivery chute, discharge motor means on each said tier operable to displace any one said bin gate assembly on its respective tier, whereby upon displacement of any one said gate assembly, any product within the respective said bin is directed into said delivery chute, said gate assembly includes a lever pivotally attached to each said bin, and said lever and discharge motor means are provided with cooperating cam surfaces.

2. An automated delivery system according to claim 1 including;

electronic control components connected to said indexing and discharge motor means, and customer controlled input means connected to said control components and operable to actuate said motor indexing and discharge means.

3. An automated delivery system according to claim 2 wherein, said input means includes a keyboard, a video monitor adjacent said input means and connected to said control components, and check controlled apparatus connected to said control components.

4. An automated delivery system according to claim 1 wherein;

each said bin includes an outer open end and said gate assembly includes a product gate normally blocking said bin open end.

5. An automated delivery system according to claim 4 wherein, said bins are inclined downwardly toward said open end whereby, said product is directed by gravity from said bins to said chute.

6. An automated delivery system according to claim 5 wherein, each said bin includes a pair of vertical side walls joined to a bottom wall and a rear wall, and each said gate assembly comprising a lever pivotally attached to one said bin side wall.

7. An automated delivery system according to claim 1 wherein, said wheel assembly support means includes a vertical tube having gear means thereon, and said indexing motor means engageable with said tube gear means.

8. An automated delivery system according to claim 1 including, a stationary support member adjacent each said tier, each said discharge motor means mounted upon one said support member, and said discharge motor means mounted in radial alignment with said delivery chute.

9. An automated delivery system according to claim 1 including, a fixed vertical shaft extending through the central axis of said wheel assembly, and

10. An automated delivery system according to claim 1 including, stationary support means attached to each said discharge motor means.

* * * * *